United States Patent [19]

Sussman

[11] 4,118,084

[45] Oct. 3, 1978

[54] STACKABLE COMPARTMENTALIZED STRUCTURE FOR COSMETICS OR THE LIKE

[76] Inventor: Howard Sussman, c/o Crackerbarrel Marketing, E. Shore Rd., Huntington, N.Y. 11743

[21] Appl. No.: 853,249

[22] Filed: Nov. 21, 1977

Related U.S. Application Data

[63] Continuation-in-part of Ser. No. 797,304, May 16, 1977, abandoned.

[51] Int. Cl.[2] ..... A47B 87/00

[52] U.S. Cl. ..... 312/107; 312/111; 312/257 R; 206/509; 108/53.5

[58] Field of Search ..... 312/107, 111, 257 SK, 312/108, 107.5, 257 R; 206/509; 108/53.3, 53.5, 91

[56] References Cited

U.S. PATENT DOCUMENTS

| | | | |
|---|---|---|---|
| 1,656,868 | 1/1928 | Davis et al. | 312/111 |
| 1,862,609 | 6/1932 | Shaw | 312/107 |
| 3,203,744 | 8/1965 | Batke et al. | 312/111 |
| 3,368,856 | 2/1968 | Tisdall et al. | 312/111 |
| 3,464,372 | 9/1969 | Fiterman et al. | 312/111 |
| 3,570,697 | 3/1971 | Langston | 206/509 |
| 3,741,450 | 6/1973 | Seastrom | 312/108 |
| 3,918,781 | 11/1975 | Paris | 312/111 |

*Primary Examiner*—Victor N. Sakran
*Attorney, Agent, or Firm*—Bauer, Amer & King

[57] ABSTRACT

A compartmentalized structure for storing cosmetics or the like having an improved construction permitting vertical stacking with structures similarly constructed, wherein depending legs project into side-by-side positions with upper edges of a mounting recess to minimize sidewise shifting in a multi-tier arrangement of the units while a medially located interconnected male and female projection and notch minimize shifting in all remaining directions.

3 Claims, 2 Drawing Figures

STACKABLE COMPARTMENTALIZED STRUCTURE FOR COSMETICS OR THE LIKE

Figure 1:
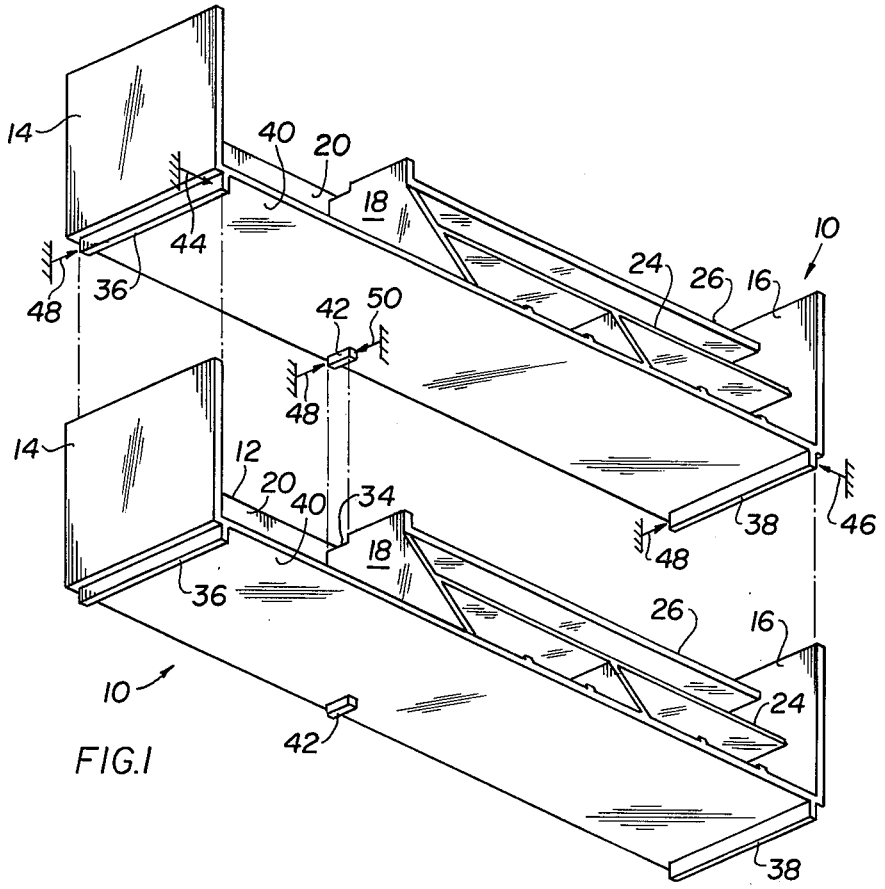

This is a continuation-in-part of Application Ser. No. 797,304, filed May 16, 1977, now abandoned.

The present invention relates generally to an improved convenience product for storing cosmetics or the like, the same generally being a familiar type of compartmentalized plastic structure having appropriately sized shelves and openings to receive such cosmetic products as lipstick tubes, bottled perfume and nail polish, face powder boxes and similar packaged cosmetics. More particularly, the invention relates to an improved construction for a plastic storage structure which facilitates vertical stacking with structures similarly constructed.

Undoubtedly because of the sheer number of packaged cosmetics, and the tendency of same to have an untidy appearance unless stored with some order and organization, there are various compartmentalized structures available specifically tailored to the storage of cosmetics. These available or prior art storage structures provide storage space to varying extents as a function of their design, and as additional storage space is required, additional units are purchased and used. It is at this point, however, that these units lack the inherent capacity to provide total satisfaction. These individual units, by reason of being unconnected and/or otherwise effectively integrated with each other, start to contribute to the same untidy appearance that it was desired to obviate.

Broadly, it is an object of the present invention to provide an improved cosmetic storage unit overcoming the foregoing and other shortcomings of the prior art. Specifically, it is an object to provide storage units of standardized construction that readily stack vertically, thereby contributing to a neat appearance whether used alone or in a multi-unit arrangement.

A compartmentalized structure for storing cosmetics or the like demonstrating objects and advantages of the present invention includes, as an adjunct to conventional structural features, a vertically oriented rear wall having a cooperating arrangement of two opposite side walls and a medial wall connected to extend forwardly thereof, the side walls being at locations adjacent the opposite sides thereof and the medial wall located therebetween. Also included are first and second horizontally oriented top shelf panels positioned to extend in spanning relation from opposite sides of the medial wall to these side walls, said panels being at a level slightly below the upper edges of the rear, opposite side and medial walls so as to cooperate therewith in bounding an upper mounting recess for the structure. Completing the essential structure is a female mounting notch formed by the removal of a section from the medial wall at a location adjacent the rear wall. Each storage structure has opposite side legs and a male mounting projection extending in depending relation from its bottom wall so as to project within the mounting recess of a cooperating similarly constructed structure occupying a position beneath it. Thus, in a vertically stacked arrangement the side legs project into the mounting recess and assume side-by-side positions with the upper edges of the side walls and are therefore effective in minimizing sidewise shifting in the upper structure relative to the lower. The stacked arrangement also results in an interconnection between the male and female projection and notch which has the significant effect of minimizing shifting in all remaining directions.

Figure 2:
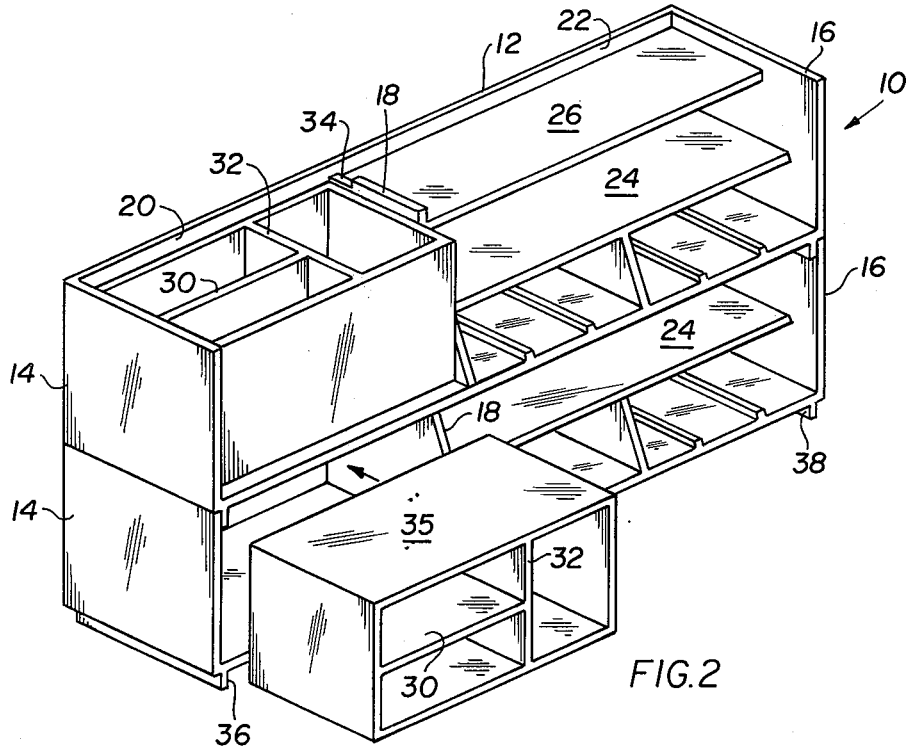

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 1 is a partial perspective view which highlights the noteworthy structural features of the within product, said features contributing to the ability to vertically stack two or more similarly constructed products; and FIG. 2 is a perspective view illustrating two such products in a vertically stacked arrangement.

Illustrated in FIG. 2 is a superposed arrangement of identically constructed plastic structures, individually and collectively designated 10. The contemplated end use for each unit 10 is to function as a compartmentalized structure for storing cosmetics or other such items which, if not confined to a single location, tend to provide an unsightly appearance. In any event, each unit 10 consistent with its ability to function as a convenience product is subdivided or compartmentalized by walls and panels which cooperate to bound various storage compartments appropriately sized for typical cosmetic products such as lipstick tubes, bottled nail polish, boxes of face powder, etc. In accordance with the present invention, not only is such unit 10 structurewise appropriately compartmentalized, but each is also so constructed that it is readily stacked one upon the other to any reasonable height, a two-tier or two-unit construction being illustrated in FIG. 2. This has the obvious advantage to the end user of doubling the storage space and yet, from a manufacturing point of view, separate manufacturing tools or machinery are not required since the stacked units are similarly constructed. That is, there is no special construction for the unit 10 when it is used alone as against when it is combined in stacked relation with other such units.

As a compartmentalized structure, each unit 10, in a preferred form as illustrated, includes a vertically oriented rear wall 12 which has opposite side walls 14 and 16 extending forwardly therefrom. Also extending forwardly of the rear wall at an intermediate location is a divider or medial wall 18, the function of which is to subdivide the overall volume bounded by the walls 12, 14 and 16 into smaller-sized sections or portions 20 and 22. Section 22 is further subdivided into still even smaller-sized compartments by a lower, horizontally oriented wall or panel 24 which is connected in spanning relation between one surface of the medial wall 18 and the side wall 16 in facing relation therewith. Spaced above panel 24 is a top panel 26, also horizontally oriented and connected in spanning relation between the medial wall 18 and side wall 16. It should be noted that top panel 26 is positioned slightly below the uppermost edges of the vertically oriented walls so that it effectively cooperates with these upper edges in forming or bounding a mounting recess in the upper portion of the section or compartment 22. The significance of this mounting recess, which for convenience is also designated 22, will soon be apparent.

The compartment section 20 on the opposite side of the medial wall 18 is advantageously used for the operative positioning of a smaller-sized, subdivided structure 35. The internal volume of structure 35 is subdivided by intersecting walls 30 and 32 which in a vertical orientation, as depicted by the upper unit of the two-unit structure of FIG. 2, provides correspondingly vertically oriented cosmetic storage compartments. However, by turning structure 35 on its side, as illustrated by the lower unit in FIG. 2, the storage compartments are of course horizontally oriented. Also, when structure 35 is horizontally oriented, its wall 34 then serves as a companion top shelf panel along with the previously noted top panel shelf 26. That is, like panel 26, panel 34 is horizontally oriented at a level slightly below the upper edges of the vertically oriented walls of unit 30 so that it cooperates with these upper edges to also bound and form a mounting recess in the upper portion of section 20.

Completing the significant structural features of each unit 10, at least so far as contributing to the stackability of such units, it will be noted that medial wall 18 has its rear portion adjacent the rear wall 12 removed therefrom thereby providing a female mounting notch 34.

Reference should now be made to FIG. 1 which most clearly illustrates how two or more units 10 effectively vertically stack. The stacking structure consists of side legs 36 and 38 which extend in depending relation from a bottom wall 40, said wall also having extending in depending relation therefrom a male mounting projection 42. As is clearly illustrated in FIG. 1, the position of the side legs 36 and 38 is such that when an upper unit 10 is placed on top of a supporting lower unit 10 these legs project into the mounting recess 20, 22 and occupy side-by-side positions with the upper edges of side walls 14 and 16. As a consequence, and as illustrated by the reference arrows 44 and 46, the cooperating operative positions of the legs 36, 38 and the upper portions of the side walls 14, 16 prevent any sidewise shifting in the upper unit 10 relative to the lower unit 10.

Male mounting section 42 is also in aligned relation with the female notch 34 so that the superposed position of one unit 10 on the other results in the interfitting of projection 42 in notch 34. As a consequence, and also as is illustrated by the reference arrows 48 and 50, this prevents fore and aft shifting of the superposed units 10 relative to each other. Thus, in this very simple and effective way, two or more superposed units 10 are effectively maintained in a desired superposed or vertically stacked arrangement.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A compartmentalized structure for storing cosmetics or the like having an improved construction permitting vertical stacking with structures similarly constructed, said structure comprising a vertically oriented rear wall, a cooperating arrangement of two opposite side walls and a medial wall connected to extend forwardly from said rear wall at locations adjacent the opposite sides thereof and at an intermediate location, first and second horizontally oriented top shelf panels positioned to extend in spanning relation from opposite sides of said medial wall to said side walls at a level slightly below the upper edges of said rear, opposite side, and medial walls so as to cooperate therewith in bounding an upper mounting recess for said structure, said upper edge of said medial wall in said mounting recess having a section removed therefrom adjacent said rear wall for forming a female mounting notch, and an inwardly located opposite side legs and a male mounting projection extending in depending relation from the bottom wall of said structure so as to project within said mounting recess of a cooperating similarly constructed structure in a supporting position beneath same, said opposite side legs being at locations to assume side-by-side positions with said upper edges of the walls bounding the opposite sides of said mounting recess and said male mounting projection being at a location to project within said female mounting notch, whereby said side legs minimize sidewise shifting in the superposed structures relative to each other and said interconnected male and female projection and notch minimize shifting in all remaining directions.

2. A stackable structure as defined in claim 1 wherein at least said first horizontally oriented top shelf panel is physically connected at opposite ends to extend between said medial wall and one said side wall, to thereby contribute to the rigidity of said structure.

3. A stackable structure as defined in claim 2 wherein said second horizontally oriented top shelf panel is a wall of a smaller-sized structure positionable between said medial wall and said opposite side wall.

* * * * *